United States Patent [19]

Richter

[11] 4,356,004

[45] Oct. 26, 1982

[54] PROCESS FOR FORMING CHARGING FUEL INTO AGGLOMERATES FOR THE PRESSURE GASIFICATION OF COAL

[76] Inventor: Artur Richter, Langensiepenstrasse 25, D-4330 Mulheim, Fed. Rep. of Germany

[21] Appl. No.: 165,851

[22] Filed: Jul. 7, 1980

Related U.S. Application Data

[63] Continuation-in-part of Ser. No. 970,668, Dec. 18, 1978, abandoned.

[30] Foreign Application Priority Data

Jan. 24, 1978 [DE] Fed. Rep. of Germany ..... 2802954

[51] Int. Cl.[3] ..... C10J 3/00

[52] U.S. Cl. ..... 48/210; 44/16 F; 48/86 R; 201/6

[58] Field of Search ..... 48/86 R, 210, 202, 197 R; 44/10 C, 16 F; 201/6; 165/163, 87

[56] References Cited

U.S. PATENT DOCUMENTS

| | | | |
|---|---|---|---|
| 1,224,335 | 3/1917 | Smith | 165/163 |
| 2,707,148 | 4/1955 | Kollgaard | 48/202 |
| 3,263,748 | 8/1966 | Jemal et al. | 165/87 |
| 3,310,836 | 3/1967 | Nichols | 165/87 |
| 3,893,504 | 7/1975 | Gaines, Jr. | 165/163 |
| 4,033,730 | 7/1977 | Boson et al. | 48/86 R |
| 4,057,400 | 11/1977 | Kaimann et al. | 48/86 R |

FOREIGN PATENT DOCUMENTS

| | | | |
|---|---|---|---|
| 2629182 | 12/1977 | Fed. Rep. of Germany | 48/210 |

*Primary Examiner*—S. Leon Bashore, Jr.
*Assistant Examiner*—Michael L. Goldman
*Attorney, Agent, or Firm*—Remy J. VanOphem

[57] ABSTRACT

A process for forming charging fuel into agglomerates for the pressure gasification of coal, comprises the steps of mixing fine, granular charging fuel with a binder outside the pressure reactor, subjecting the mixture, in a pressure vessel, to the pressure prevailing in the reactor, and feeding agglomerates produced from the mixture to the fixed bed of the reactor from above. The mixture is made with a binder which hardens when heated and is kept below hardening temperature during subsequent subjection to pressure until fed to the reactor, the agglomerates being produced by hardening of the binder in the heat prevailing in the reactor above the fixed bed.

3 Claims, 1 Drawing Figure

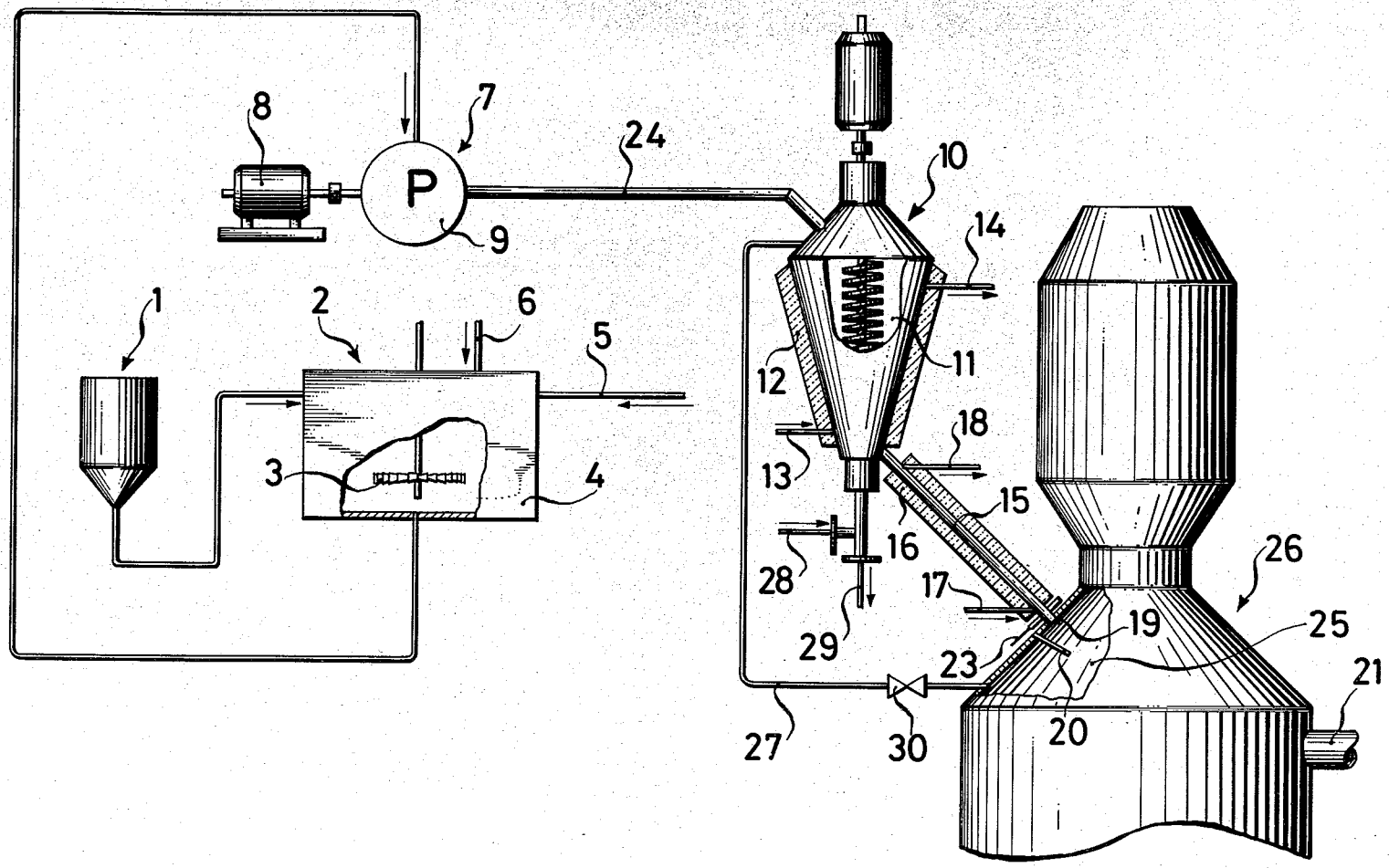
1
2
3
4
5
6
7
8
9
P
10
11
12
13
14
15
16
17
18
19
20
21
23
24
25
26
27
28
29
30

PROCESS FOR FORMING CHARGING FUEL INTO AGGLOMERATES FOR THE PRESSURE GASIFICATION OF COAL

CROSS-REFERENCE TO RELATED APPLICATION

This application is a continuation-in-part of Ser. No. 970,668, filed Dec. 18, 1978 now abandoned.

BACKGROUND OF THE INVENTION

Field of the Invention

The invention relates to a process for forming charging fuel into agglomerates for the pressure gasification of coal, in which the fine, granular charging fuel is mixed with a binder outside the pressure reactor, the mixture is subjected to the pressure prevailing in the reactor, and the agglomerates produced from the mixture are fed to the fixed bed of the reactor from above.

The invention relates in particular to the pressure gasification of bituminous coal and will therefore be explained in greater detail with respect to this charging fuel. The pressure gasification of bituminous coal is known per se and is generally carried out in a column reactor in which the charging fuel forms a fixed bed. The exothermic reactions of the charging fuel with air and oxygen, respectively, and steam proceeds in the fixed bed. Above the fixed bed, the hot producer gas has a pressure of approximately 20 atmospheres. The continuity of the process, on the one hand, and the excess pressure in the reactor, on the other hand, require the feeding of the charging fuel in respective required amounts.

The charging fuel fed to the reactor must have a definite granular structure to ensure the most favourable consumption possible in the fixed bed and the least possible contamination in the producer gas. Generally, fine coal, i.e., a mixture of material originating from the preparation of coal with a granular size of 0 to 30 mm, is gasified. Granules with a size of 0 to 6 mm must be removed from this granular range, because these interfere with the draught in the shaft and, inter alia, lead to an unfavourable rise in the dust content of the producer gas. On the other hand, care must be taken that the expense connected with the preparation of the coal for gasification is kept as low as possible; on the other hand, as much of the fine coal as possible should be used as charging fuel in the reactor.

It is already known (from German Offenlegungsschrift No. 2,540,166) to grade the fine coal at 2 mm, and to feed the granules above this size directly to the reactor and to make briquettes from granules below this size by mixing the granules with a binder. The making of briquettes takes place immediately above the reactor column in order to permit a pressure-tight seal of the reactor with the briquetting press. In this process, the briquettes falling onto the fixed bed have a relatively low strength, because they cannot be cooled off after leaving the briquetting press. However, the strength or firmness of the brightness precludes blocking of the column because the agglomerate from which the briquettes are formed is permeable to gas.

A disadvantage of this known process is that the briquetting press has to be accommodated in a system which is sealed off from the outside, because the finished material cannot provide a completely sealed gas seal and there exists a danger of blow-outs of gas from the reactor. Mixing coal dust and binder in such a system in per se not without risk, but it is necessary in order to keep the amount of binder down; this requirement results from the relatively high price of the binder which is a kind which hardens on cooling. Furthermore, the granular range of the briquette material must be very accurately maintained in order to achieve adequate strength of the agglomerate. However, once the strength has been achieved, it can no longer be checked, and this is a disadvantage. This is the result of the arrangement and the employment of the briquetting press which effectively excludes access to the briquetted material. Furthermore, problems arise in ensuring adequate lubrication of the machine parts, which gives rise to risk of explosions. Also, the entire plant is not very conducive to repairs. Finally, the provision of a gas-tight seal between the briquetting press and reactor means that when defects arise in the briquetting press, the reactor has to be put out of action.

It is also known (Canadian patent specification No. 988301) to use a worm extruder the mouth of which is connected, by a pipe, to the inner chamber of the reactor above the fixed bed. A hollow cylindrical or solid rope of the material mixed with the binder is produced by the extruder, which is pushed forwards through a connection pipe leading to the reactor, and a vertically movable knife in the reactor cuts off pieces of the material which fall onto the fixed bed.

The disadvantages of this device are essentially the same as stated above for the briquetting press. For also when using an extruder, a sealed pressure-tight system must be provided, the charging fuel must be graded within narrow limits and, in addition, be milled before producing the mixture. The required binder sets on heating and is expensive, and the pressure-tight seal cannot be made fully effective.

The object of the invention is the simplification of the shaping into lumps of the charging fuel, whereby the necessary preparation of the charging fuel for gasification is considerably reduced, the use of machinery is also greatly reduced, and the pressure-tight seal of the reactor is improved.

SUMMARY OF THE INVENTION

According to the invention, this task is resolved in that the mixture is made with a binder which hardens when heated but which is kept below hardening temperature during subsequent subjection to pressure until fed to the reactor and that the agglomerates are produced by hardening of the binder with the heat prevailing in the reactor above the fixed bed.

The use of a binder which hardens when heated instead of when cool obviates the use a briquetting machine because hardening, or setting, of necessity takes place after the mixture has been introduced into the reactor and before it reaches the fixed bed. The prevailing temperatures above the fixed bed of e.g. 600° C. are sufficient to create a hard shell which prevents the collapse of the agglomerates in the fixed bed happening too quickly. Sulphite liquor, known per se in briquetting, is particularly suitable as a binder, and also has the advantage, since it is a waste product in the manufacture of paper, of being available in any required quantity without appreciable expense.

The production of the agglomerates requires no grading within narrow limits, but only a good coating of the granules of the charging fuel with the binder. While this demands a relatively large amount of binder, this is of little importance because of the nature of the binder. Because of this, in the process according to the invention, relatively little expense need be involved in the preparation of a charging fuel, or such preparation can be dispensed with entirely. In the first case, the material is graded with a suitable sieve and the oversize granules are fed directly to the reactor separately. In the second case, all granular grades are included in the preparation of the mixture, or the agglomerates, respectively. Also, in the process according to the invention, no press is needed for the production of the agglomerates, since the heat of the reactor is used for this purpose.

The introduction of the mixture through a closed conduit, for example a pipe, has additionally the advantage that the non-hardened mixture acts as a pressure-tight seal as long as the hardening of the binder has not been initiated. In order to prevent such hardening, the mixture is preferably cooled after it has been subjected to pressure and before being fed to the reactor. If, for any reason, feeding of the mixture is interrupted, pressure-tight sealing of the reactor from the exterior can be effected by a slide installed in the above-mentioned conduit, or by another suitable valve, and on renewed feeding of the mixture, after opening the slide, the mixture can be again used as the pressure-tight seal.

Furthermore, the invention has advantages which result from the preparation of the mixture being carried out under ambient pressure. Such a system can easily be supervised, can be easily maintained and enables checking of the mixture at any desired moment.

BRIEF DESCRIPTION OF THE DRAWING

The accompanying drawing shows, schematically, a plant for carrying out a process according to the invention.

DETAILED DESCRIPTION OF THE PREFERRED EMBODIMENT

The graded fine coal comes from the coal preparation equipment 1 and before being processed further is sieved for undersize granuales. The undersize granules which have a grain size from 0 to 30 mm and which have passed through the sieve, leave the coal preparation equipment and are conveyed to a mixer 2. The mixing device itself is generally indicated at 3 and is known per se. It therefore requires no further explanation. Also, through a conduit 5, sulphite liquor is introduced into the mixing vessel 4, and water is added through a conduit 6. The mixture is passed to a pump assembly 7, the drive of which is indicated at 8. The pump 9 itself can feature an eccentric worm, or maybe a mono-pump or a sludge pump of another construction. The pump 9 has the job of subjecting the mixture to increased pressure and simultaneously conveying it, through a pipe 24, into a hollow worm heat exchanger or conical worm dryer 10. In the internal chamber 11 of this apparatus, there prevails the pressure which also prevails in the internal chamber 25 of the reactor, indicated generally at 26. A pressure equalization line 27, which connects the internal chamber 11 of the apparatus 10, serve for this purpose. A valve element 30 is provided in the line 27. The hollow worm heat exchanger 10 has a cooling jacket 12, which is fed at 13 with liquid coolant, e.g., water, which is led off at 14. Furthermore, the hollow worm itself is also cooled, the coolant input being indicated at 28, and the coolant output at 29.

At the lower end of the apparatus 10 is a downwardly inclined conveyor pipe 15 which opens out at 19 into the internal pressure chamber 25 of the reactor 26. The pipe 15 also has a coupling jacket 16. The coolant intake is indicated at 17 and the coolant is drawn off at 18.

Below the outlet 19 from the conveyor pipe 15, there is a guide plate 20. Shortly before the outlet 19, there is a valve element, for example, a cut-off slide 23, in the pipe 15.

The chamber 25 in the pressure reactor 26 lies above the fixed bed, which is not shown. In the chamber is producer gas which can be drawn off at 21. The temperature is around 600° C.

In operation, the mixture from the mixer 2 is forced by the pump 9, with the drive 8 running, through the pipe 24 into the inner chamber 11 of the hollow worm heat exchanger 10. The mixture forms a pressure-tight and heat-checking seal in the pipe 24. The mixture is delivered under the action of gravity through the pipe 15, which is shown according to the embodiment to be included at 45°, into the pressure chamber 25 of the reactor, with the valve element 23 open. The mixture forms a pressure-tight seal in the pipe 15 also, so that the apparatus is secured at several points.

Generally, the feeding of the charging fuel, which has been prepared in the mixer 2, is continuous. In so far as the feed has to be interrupted, it is sufficient to close the valve elements 23 and 30. Control of the feed amounts is carried out by altering the speed of rotation of the hollow worm.

If the conveyor pump assembly 7 fails, then loading of the reactor can be continued from the store in the pressure vessel (if necessary with reduced performance). In the meantime, repair or replacement of the pump is possible.

By continuous conveying, undesirable hardening of the charging fuel in the pipes (and pressure vessel) is prevented thus avoiding blocking of the exit opening.

Feeding of the coal into the reactor can also be carried out by means of a pump and a hollow worm conveyor. A water rinsing connection can be provided behind the slide, so that encrustations can be swilled off, which encrustations arise from the coagulated residues on the pump ceasing to function and with the reservoir 11 being empty.

The embodiments of the invention in which an exclusive privilege or property is claimed are defined as follows:

1. A process for forming charging fuel into agglomerates for the pressure gasification of coal, comprising the steps of: mixing fine, granular charging fuel of a particle size up to 30 millimeters, with a binder outside the pressure reactor, passing said mixture to a pump assembly, pumping said mixture through a first pipe, wherein the mixture forms a pressure-tight, heat-checking seal, and into a hollow worm heat exchanger, equalizing the pressure of the mixture when it is in the worm heat exchanger and the pressure prevailing in the reactor while cooling said mixture, feeding the mixture through a second pipe, wherein the mixture forms a pressure tight seal, to the fixed bed of the reactor from above, and gasifying the coal in the reactor; said mixture being made with a binder which hardens when heated and being kept below hardening temperature during subsequent subjection to pressure until fed to the reactor, the agglomerates being produced by hardening of the binder in the heat prevailing in the reactor above the fixed bed.

2. A process according to claim 1, wherein the binder is sulphite liquor.

3. A process according to claim 1, wherein the mixture is cooled while passing through said second pipe.

* * * * *

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

In The Abstract

Line 2, delete "comprises" and insert --- including ---.

Column 1, line 35, delete "ensure" and insert --- insure ---. Same line, delete "favoura-" and insert --- favorable ---.

Column 1, line 43, delete "unfavourable" and insert --- unfavorable --- .

Column 2, line 12, delete "ensuring" and insert --- insuring ---.

Column 2, line 24, delete "forwards" and insert --- forward ---.

Column 2, line 29, delete "For also when" and insert --- When ---.

Column 2, line 32, after the word "provided" delete the "," and insert --- and ---.

Column 2, line 33, delete "and, in" and insert --- . In ---. Same line before the word "be" insert --- the charging fuel must ---.

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

Column 2, line 37, delete "the simplification of the" and insert --- to simplify ---.

Column 2, line 38, delete in its entirety and insert --- shaping the charging fuel into lumps. The ---.

Column 2, line 40, before the word "considerably" insert --- , thus, ---. Same line delete "," and insert --- ; ---.

Column 2, line 41, delete the word "greatly". Same line delete the "," and insert --- ; ---.

Column 2, line 45, before the word "invention" insert --- present ---.

Column 2, line 49, delete "that the".

Column 2, line 52, after the word "binder" insert --- , ---.

Column 2, line 53, delete "cool" and insert --- cooled ---.

Column 2, line 54, delete "of necessity".

Column 2, line 59, delete "happening" and insert --- from occurring ---.

Column 2, line 68, delete "this" and insert --- it ---.

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

Column 3, line 2, delete "Because of this, in the process" and insert --- Therefore, ---. Same line, after "the" insert --- process of the present ---.

Column 3, line 3, delete "need be" and insert --- is ---.

Column 3, line 4, delete ", or such" and insert ---. In fact, the ---. Same line delete "can" and insert --- may ---.

Column 3, line 5, delete "first case" and insert --- preferred embodiment ---.

Column 3, line 7, delete "the second".

Column 3, line 8, delete "case" and insert --- an alternate embodiment ---.

Column 3, line 13, delete "The introduction of the mixture" and insert --- An additional advantage is realized when the mixture is introduced ---.

Column 3, line 14, delete "has additionally the advan-".

Column 3, line 15, delete "tage that" and insert --- as ---.

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

Column 3, line 17, delete "such" and insert --- its ---.

Column 3, line 22, after "conduit" insert --- or pipe ---.

Column 3, line 28, delete ", can be easily" and insert --- and ---. Same line after "maintained" insert --- , ---.

Column 3, line 50, delete "itself". Same line delete "or maybe".

Column 3, line 52, delete "has the job of subjecting" and insert --- subjects ---.

Column 3, line 53, delete "conveying" and insert --- conveys ---.

Column 3, line 57, after the word "internal" insert --- pressure ---.

Column 3, line 59, delete "for".

Column 4, line 1, before the word "pipe" insert --- conveyor ---. Same line delete "coupling" and insert --- cooling ---.

Column 4, line 5, after "element" insert --- 23 ---. Same line after "slide" delete "23". Same line after "the" insert --- conveyor ---.

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

Column 4, line 7, before the word "chamber" insert --- internal pressure ---.

Column 4, line 13, delete "inner" and insert --- internal ---.

Column 4, line 16, before the word "pipe" insert -- conveyor ---.

Column 4, line 18, delete "included" and insert --- inclined ---. Same line before "pressure" insert --- internal ---.

Column 4, line 19, after the word "reactor" insert --- 26 ---. Same line, after the word "mixture" insert --- also ---.

Column 4, line 20, delete "also".

Column 4, line 30, after "vessel" delete "(" and insert --- , ---. Same line, after "performance" delete ")".

Column 4, line 34, after "pipes" delete "(" and insert --- , ---. Same line, delete ")" and insert --- , ---.

Column 4, line 39, delete "which" and insert --- when ---. Same line, delete "arise" and insert --- form ---.

UNITED STATES PATENT AND TRADEMARK OFFICE

CERTIFICATE OF CORRECTION

PATENT NO. : 4,356,004

DATED : October 26, 1982

INVENTOR(S) : Artur Richter

It is certified that error appears in the above-identified patent and that said Letters Patent is hereby corrected as shown below:

Column 4, line 40, delete "ceasing to function and with the reservoir".

Column 4, line 41, delete "ll being empty.".

Signed and Sealed this

*Tenth* Day of *January 1984*

[SEAL]

*Attest:*

GERALD J. MOSSINGHOFF

*Attesting Officer*

*Commissioner of Patents and Trademarks*